US006588756B1

(12) United States Patent
Hughes

(10) Patent No.: US 6,588,756 B1
(45) Date of Patent: Jul. 8, 2003

(54) PLAYING CARD SYSTEM FOR TEACHING MUSICAL NOTATION

(76) Inventor: Kimberly D. Hughes, 1 Benchmark Dr., Boulder, CO (US) 80303

( * ) Notice: Subject to any disclaimer, the term of this patent is extended or adjusted under 35 U.S.C. 154(b) by 0 days.

(21) Appl. No.: 09/440,362

(22) Filed: Nov. 15, 1999

Related U.S. Application Data

(60) Provisional application No. 60/109,199, filed on Nov. 20, 1998.

(51) Int. Cl.[7] ..... A63F 1/00

(52) U.S. Cl. ..... 273/292; 273/293; 273/299; 273/300; 273/301; 273/302; 273/303; 273/304; 273/305; 273/306

(58) Field of Search ..... 273/292, 293, 273/299, 300, 301, 302, 303, 304, 305, 306

(56) References Cited

U.S. PATENT DOCUMENTS

| | | | | | |
|---|---|---|---|---|---|
| 702,298 | A | * | 6/1902 | Frederickson | 273/301 |
| 1,139,098 | A | * | 5/1915 | Bostwick | 273/301 |
| 1,217,810 | A | * | 2/1917 | Noel | 273/301 |
| 1,392,977 | A | * | 10/1921 | Swan | 273/301 |
| 1,589,878 | A | * | 6/1926 | Gilbert | 273/301 |
| 1,599,568 | A | * | 9/1926 | Koehler | 273/301 |
| 1,675,528 | A | * | 7/1928 | Bishop | 273/301 |
| 2,231,020 | A | * | 2/1941 | McCaulley | 273/301 |
| 2,582,544 | A | * | 1/1952 | Johnson | 273/301 |
| 2,619,867 | A | * | 12/1952 | Frisch | 273/301 |
| 3,667,759 | A | * | 6/1972 | Barr | 273/293 |
| 4,061,337 | A | * | 12/1977 | Callender | 273/243 |
| 4,465,282 | A | | 8/1984 | Dillon | |
| 4,819,539 | A | * | 4/1989 | Searing | 273/301 |
| 4,895,374 | A | | 1/1990 | Bowles | |
| 5,441,277 | A | * | 8/1995 | Lenhart et al. | 273/249 |
| 5,540,132 | A | | 7/1996 | Hale | |
| 5,607,159 | A | * | 3/1997 | Bryson | 273/146 |
| 6,015,947 | A | * | 1/2000 | Moberg | 84/471 R |

FOREIGN PATENT DOCUMENTS

| | | | | |
|---|---|---|---|---|
| GB | 2027974 | A | * 2/1980 | A63F/1/00 |

OTHER PUBLICATIONS

Merriam–Webster's Collegiate Dictionary—Tenth Edition, pp. 1023–1024.*

Merriam—Webster's Collegiate Dictionary—Tenth Edition, pp. 1023–1024.*

Leonard Schneir—Gambling Collectables A Sure Winner—1993—Schiffer Publishing Ltd.—p. 130.*

Willi Apel, Harvard Dictionary of Music, 1978, pp. 179–180, 581–582, 806, 2nd Edition, Belknap Press of Harvard University Press, Cambridge, Mass, USA.

* cited by examiner

*Primary Examiner*—Benjamin H. Layno
*Assistant Examiner*—Dolores Collins

(57) ABSTRACT

An apparatus for teaching musical notation to students by playing familiar card games. A deck of playing cards is utilized which contains musical notation and colored suits rather than the typical numbers with named suits. The musical notation symbols are printed in the corners of the cards to allow them to be used in card games. The deck can be used to play a variety of common card games such as Crazy 8's and Go Fish, as well as new games that take advantage of unique musical notation. By playing card games with these musical notation cards, the student becomes fluent in reading music.

8 Claims, 6 Drawing Sheets

PLAYING CARD SYSTEM FOR TEACHING MUSICAL NOTATION

CROSS REFERENCE TO RELATED APPLICATION

This application claims priority under 35 U.S.C. sctn. 119(e) from U.S. provisional patent application Ser. No. 60/109,199 filed on Nov. 20, 1998 entitled "Playing Card System for Learning Musical Notation", incorporated herein by reference.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

This invention relates to playing cards used for educational and entertainment purposes, and more particularly to a versatile deck of musical notation cards which may be used in many ways to play many different games.

To entice students to memorize musical notation for the purposes of reading and performing music, the present invention endeavors to make this experience more entertaining, and thus more successful.

2. Description of the Prior Art

Many games, educational methods and teaching aids have been created to assist students in learning how to read music. Illustrative examples of earlier approaches include those set forth in the following U.S. Patents:

U.S. Pat. No. 5,540,132 (Hale) teaches of music education system involving symbolism. U.S. Pat. No. 702,298 (Frederickson) teaches of a musical card game. U.S. Pat. No. 4,465,282 (Dillon) and U.S. Pat. No. 4,895,374 (Bowles) disclose new board games that relate to musical education.

Another common method for teaching music notation is by utilizing flash cards. These cards contain a musical note or symbol, and the student is asked to name the note or symbol as quickly as possible.

The prior art systems involve new and different game rules, so the student must learn a new game as well as the new language of music. This can become too complex to the student and result in disinterest and lack of desire for repeated play. Specific games also tend to appeal to a limited skill level and limited audience. The game may quickly lose its appeal after a few rounds of play.

In learning musical notation and terminology, the desired goal is simply associating the visible musical note with its given alphabetical name, and ultimately it's audible tone. Some of the prior art systems also introduce symbolism for associating notes of the scale with colors or objects. This introduces another layer of symbolism that is irrelevant and must later be disassociated with the musical notation as the student advances.

Other prior art systems are focused specifically on learning the notes as seen on the piano keyboard. Many other instrumentalists or vocalists would benefit from a more general approach to learning musical notation.

The flash card system is excellent at providing a means for rote memorization, with no intermediate symbolism introduced. However, it becomes quickly uninteresting and is typically regarded as a chore rather than entertainment. Thus, students tend to be less focused and efficient in learning the notation, and the distaste can continue into the other aspects of learning how to perform music as well.

What is needed therefore, and an object of the present invention, is an efficient method and apparatus for learning and memorizing musical notation in a straightforward approach, which involves repetitive use of the language of music while playing games that are already familiar to the student from his previous experience.

It has been shown that repetition is an important technique for learning any new language. Musical notation, a system of circles and lines and spaces, can be considered a new language to a beginning student. Normally, the repetition and memorization only occur in a music lesson or through homework or other assignment. An entertaining method for providing this repetition is needed to capture the interest of the student for a long enough period so successful memorization can occur.

Other basic languages can be reinforced and taught throughout everyday life. The letters of the alphabet, colors, and basic mathematical relationships can be seen in many aspects of the student's normal environment. Exposure and memorization can occur continually throughout the day. The language of music, however, is not readily apparent in everyday life. In order to learn this language, specific exposure needs to be instigated. Repetitive exposure through the play of entertaining games is an effective technique for learning and remembering the names and meanings of musical notation.

SUMMARY OF THE INVENTION

This invention enables students to learn the language of music by using musical notation while playing common card games, which should already be familiar to the student. By repeatedly using musical notation while playing familiar card games, the student quickly becomes comfortable with reading music.

A deck of playing cards is disclosed which utilizes musical notation and colored suits instead of the typical numbers with named suits. The musical notation symbols are printed in the corners of the cards to allow them to be used in card games. The musical symbols are shown exactly as they would appear in normal printed sheet music. For example, the treble clef notes are shown on the normal musical staff, with the treble clef indicia in its normal location at the beginning of the staff.

The deck can be used to play common card games such as "Memory" and "Go Fish". The games are played by matching and naming the musical notes or symbols, instead of matching the traditional numbers as would be done with a typical deck of cards. This invention is based on games already proven to be entertaining because of their popularity. Furthermore, additional rules can be applied due to the unique nature of musical notation. For example, a match can consist of matching the name notes across octaves as well as identical note matches. By reading musical notation while playing card games, the familiarity and comfort with the notation comes very quickly.

Increased fluency in music reading can be achieved by playing increasingly difficult or more complex games. Beginning students can learn on simplified versions of the "Old Maid" game by playing with a small number of cards. Increased proficiency can lead to playing more complicated games such as "Spoons" or "Klondike Solitaire".

As the student becomes familiar with the musical notes, extra cards with additional musical symbols can be added to certain games to make them more interesting. Several unique musical notation cards can be added to make the game "Crazy 8's", for example, more tailored towards musical enthusiasts, and increase the vocabulary of the students in the language of music.

Furthermore, the deck is general enough in nature to allow creative players to invent new games, or more interesting variations of popular traditional card games.

Hence, this single game system with this versatile deck of cards may be used in many ways to play many different games, and accommodate a variety of skill and age levels. Solitaire as well as group games can be played, to accommodate individual study or large groups or classes.

Motivating students to memorize musical notation for the purposes of reading and performing music is a common problem. The present invention endeavors to make this experience more entertaining, and thus more successful. Children and adults enjoy playing games, particularly familiar card games. With this inventive game, children can enjoy learning and practicing musical notation with adults or amongst themselves, without the supervision of a parent or teacher.

Adults find the games entertaining because they force the player to think in terms of a language not typically associated with these games. This single inventive card game system that appeals to adults as well as children has a further advantage in that children are motivated to play a game that adults seem to enjoy. Even if the actual game played is different and more in line with their skill level, the same novel deck of cards is used. Adults will find that using this game system will initiate an overall interest in children learning the language of music.

The games appeal to a wide range of skill and age levels, and support individual play as well as group participation. Furthermore, the games are general enough to teach musical notation itself, not as it pertains to any specific instrument. Also, the game apparatus is general enough to allow new game rules to be invented by the players to encourage improvisation and continued interest, thus enlarging the audience and lengthening the useful life of the game system.

Accordingly, an advantage of the invention is to provide an educational game which has wide appeal to a large audience of people spanning a large age group. In particular, an object is to provide a deck of cards that supports many different games, but that utilizes the language of music as the basis. Here an object is to provide a single deck of cards which can function as flash cards for teaching very young children to read music or can be used by older children and adults to play a variety of games, some being sophisticated games. A further object is to provide a means for creating games that may be invented by the players themselves.

Further advantages of this invention will appear more clearly from the following description of a non-limiting illustrative embodiment and the accompanying drawings in which like numerals designate like parts throughout the several views.

BRIEF DESCRIPTION OF THE DRAWINGS

The foregoing and other objects, features, and advantages of the invention will be apparent from the following more particular description of preferred embodiments as illustrated in the accompanying drawings. Reference characters refer to the same parts throughout the various views. The drawings are not necessarily to scale, emphasis instead being placed upon illustrating the principles of the invention.

DETAILED DESCRIPTION OF THE PREFERRED EMBODIMENT

In the following description, for purposes of explanation and not limitation, specific details are set forth in order to provide a thorough understanding of the present invention. However, it will be apparent to those skilled in the art that the present invention may be practiced in other embodiments that depart from these specific details.

The following detailed description involves musical notation terminology. For clarity, the terms are defined here in the context with which they will be used throughout the description and claims.

(A) "Indicia" are the markings on the top left and bottom right of each card. The indicia referenced herein represent musical notation.

Figure 1:
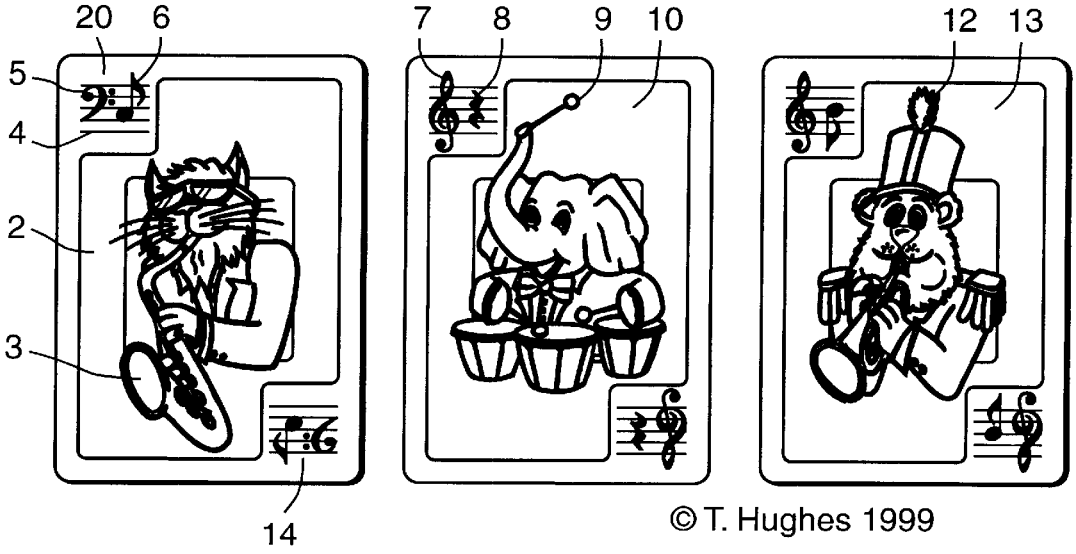
FIG. 1 shows the faces of 3 representative cards from the deck of game cards. It illustrates a Bass Clef C card in the suit of "Blue" or "Cat", a rest sign card in the suit of "Green" or "Elephant", and a Treble Clef B card in the suit of "Red" or "Bear".

(B) "Musical notation" refers to any markings that exist in written music. The specific musical notation cited in this patent disclosure is comprised of the markings defined in sections (C) through (S) below:

(C) A "note sign" is an individual marking that represents a tone of a given duration, or value. The value of the note is defined by the shape of its note sign. The common range of values spans between a whole note, meaning it lasts 4 beats, down to a $64^{th}$ note, meaning it lasts only $1/64^{th}$ of a beat. FIG. 1 shows an eighth note sign 6.

(D) A "note symbol" is defined here as a collection of note signs. In this disclosure, note symbols can be made up of from 1 to 8 note signs.

(E) A "musical staff" 4 is a collection of 5 equally spaced horizontal lines, used as a background for written musical notation.

(F) A "clef" is a sign that is placed at the left side, or beginning of the musical staff lines, to indicate the range of pitches that the following staff lines support. The most common clefs are the "Treble Clef" and the "Bass Clef", represented by the symbols 7 and 5, respectively.

(G) A "pitch sign" is created by placing a note sign on the musical staff. The position of the note sign relative to the staff lines represents a given pitch, or frequency, of the tone. The 8 pitches of a musical scale have alphabetical names in the range from A to G. The clef signs are used to further define the name of a given pitch, such as Bass Clef C. However, the range of pitches written in piano music covers a very broad range, covering several scales. Thus, there are actually several "C"s in the Bass Clef, for example. To name pitches in absolute terms, a common practice is to reference the key number on a standard 88-key piano.

(H) A "pitch symbol" is defined here as a collection of pitch signs. In this disclosure, pitch symbols can be made up of from 1 to 8 pitch signs. This allows the pitch symbols to represent chords or intervals of pitches, as well as individual pitches.

(I) An "octave" represents a doubling of the frequency of the pitches. The 8 pitches of a scale within an octave have alphabetical names in the range from A to G. These names repeat every octave.

(J) A "rest sign" represents a period of silence for a measured time, or value. The value of the rest is defined by the shape of its rest sign. The common range of values spans between a whole rest, meaning it lasts 4 beats, down to a $64^{th}$ rest, meaning it lasts only $1/64^{th}$ of a beat. FIG. 1 shows a quarter rest sign 8.

(K) A "rest symbol" is defined here as a collection of rest signs. In this disclosure, rest symbols can be made up of from 1 to 8 rest signs.

(L) A "repeat symbol" is a marking that means repeat the previous section or group of measures.

(M) A "triplet symbol" is a marking that means play the three indicated notes in the same time that one would normally play two notes of that value.

(N) A "sharp sign" means play the accompanying pitch one half step higher.

(O) A "sharp symbol" is defined here as a collection of sharp signs positioned on the musical staff. In this disclosure, sharp symbols can be made up of from 1 to 7 sharp signs.

(P) A "flat sign" means play the accompanying pitch one half step lower.

(Q) A "flat symbol" is defined here as a collection of flat signs positioned on the musical staff. In this disclosure, flat symbols can be made up of from 1 to 7 flat signs.

(R) A "natural sign" means play the accompanying pitch as written, canceling any previous sharp or flat indication.

(S) A "natural symbol" is defined here as a natural sign positioned on the musical staff.

(T) When the sharp, flat, and natural signs are used with individual pitches, they are called "accidentals". Sharp and flat symbols are also used at the beginning of a phrase of music to indicate the key signature.

Each card in the preferred embodiment is constructed of a thick paper material, such as that used in a traditional poker deck of cards. The material needs to be flexible enough to facilitate shuffling and dealing as would be done with a typical deck of cards. The inventive playing cards are substantially similar in size and aspect ratio to those cards used in a standard poker deck to allow the cards to be easily shuffled and handled during use.

Each card is uniquely identified with a colored suit indication 2 in the center body of the card and musical notation indicia in the top left 20 and bottom right 14 corner. The musical indicia are different for every card within a suit. The musical indicia are so placed so the cards can be read correctly when spread out and held in the hand regardless of their vertical orientation. This again is similar to the positioning and orientation of the indicia used on a standard poker deck of cards, to facilitate quick recognition of the indicia during holding, arranging, matching, and discarding. The musical notation in the top left corner 20 is always the same as the notation in the opposite corner 14. The name of the card is the same as the name of the musical notation represented by the indicia.

The musical indicia are shown exactly as they would appear in normal sheet music. For example, the musical notation 20 is comprised of note sign 6 shown on the normal music staff 4 with bass clef 5. This musical notation 20 represents the pitch "Bass Clef C". The treble clef 7 or bass clef 5 symbol is positioned in its normal location at the beginning, or left side, of the musical staff 4.

Three suits are used in total to make up the full deck of cards in the preferred embodiment. These suits are primarily identified with the colors, but the present invention also utilizes a cartoon of an animal playing an instrument 3 to provide further entertainment value and visual distinction, and to assist those unable to clearly discern the colors. The three suits in this embodiment are identified as follows: blue 2, or cat 3, green 10 or elephant 9, and red 13 or bear 12. These suits are used instead of the more traditional hearts, diamonds, spades, and clubs. The suit indications are exactly the same throughout each suit, so the only difference between cards of a suit is the musical indicia located in the corners of the cards. Furthermore, the musical indicia from one suit exactly match the musical indicia in another suit, to minimize confusion.

The backs of all of the cards are blank, or contain a single image or drawing that makes all of the cards indistinguishable from each other when viewed from the rear.

Figure 2:
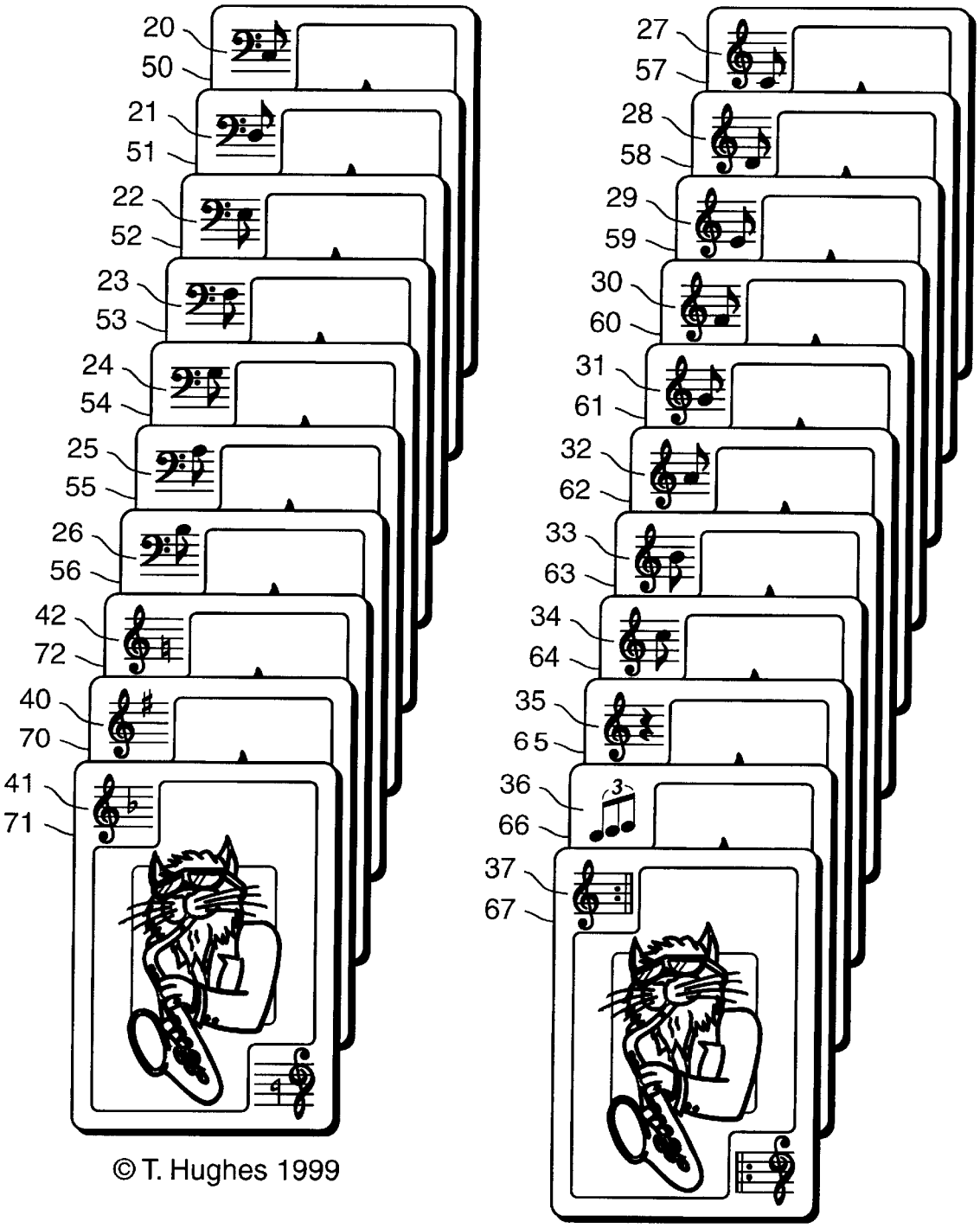
FIG. 2 shows an entire suit of 21 cards, representing a full 2-octave C-major scale of notes, a repeat sign, a triplet sign, a rest sign, a sharp sign, a flat sign, and a natural sign.

FIG. 2 illustrates all 21 cards that make up one suit, in this case the suit of blue 2 or cat 3. The pitch cards defined below are notated with eighth note pitch symbols:

(a) Bass Clef C Card 50, carrying musical indicia 20 corresponding to the pitch represented by key 28 on a standard 88-key piano, (b) Bass Clef D Card 51, carrying musical indicia 21 corresponding to the pitch represented by key 30 on a standard 88-key piano, (c) Bass Clef E Card 52, carrying musical indicia 22 corresponding to the pitch represented by key 32 on a standard 88-key piano, (d) Bass Clef F Card 53, carrying musical indicia 23 corresponding.to the pitch represented by key 33 on a standard 88-key piano, (e) Bass Clef G Card 54, carrying musical indicia 24 corresponding to the pitch represented by key 35 on a standard 88-key piano, (f) Bass Clef A Card 55, carrying musical indicia 25 corresponding to the pitch represented by key 37 on a standard 88-key piano, (g) Bass Clef B Card 56, carrying musical indicia 26 corresponding to the pitch represented by key 39 on a standard 88-key piano, (h) Middle C Card 57, carrying musical indicia 27 corresponding to the pitch represented by key 40 on a standard 88-key piano, (i) Treble Clef D Card 58, carrying musical indicia 28 corresponding to the pitch represented by key 42 on a standard 88-key piano, (j) Treble Clef E Card 59, carrying musical indicia 29 corresponding to the pitch represented by key 44 on a standard 88-key piano, (k) Treble Clef F Card 60, carrying musical indicia 30 corresponding to the pitch represented by key 45 on a standard 88-key piano, (l) Treble Clef G Card 61, carrying musical indicia 31 corresponding to the pitch represented by key 47 on a standard 88-key piano, (m) Treble Clef A Card 62, carrying musical indicia 32 corresponding to the pitch represented by key 49 on a standard 88-key piano, (n) Treble Clef G Card 63, carrying musical indicia 33 corresponding to the pitch represented by key 51 on a standard 88-key piano, and a (o) Treble Clef C Card 64, carrying musical indicia 34 corresponding to the pitch represented by key 52 on a standard 88-key piano The other musical notation cards are comprised of other symbols as followings:

(p) Rest Card 65, carrying musical indicia representing a quarter rest symbol 35, (q) Triplet Card 66, carrying musical indicia representing a triplet symbol 36, (r) Repeat Card 67, carrying musical indicia representing a repeat symbol 37, (s) Sharp Card 70, carrying musical indicia representing a sharp symbol 40, (t) Flat Card 71, carrying musical indicia representing a flat symbol 41, and a (u) Natural Card 72, carrying musical indicia representing a natural symbol 42.

All of these symbols represent common notation used in printed sheet music. These musical pitches 20–34 represent a full 2-octave C-major scale. The exact musical range shown corresponds to the tones generated by the white keys on a typical 88-key piano between and including keys 28 through 52. The piano key numbers are merely used as an absolute reference for properly designating these pitches, and does not restrict the usage of the game card deck to piano students. Eighth note values are used for all the pitch symbols in this embodiment.

Figure 3:
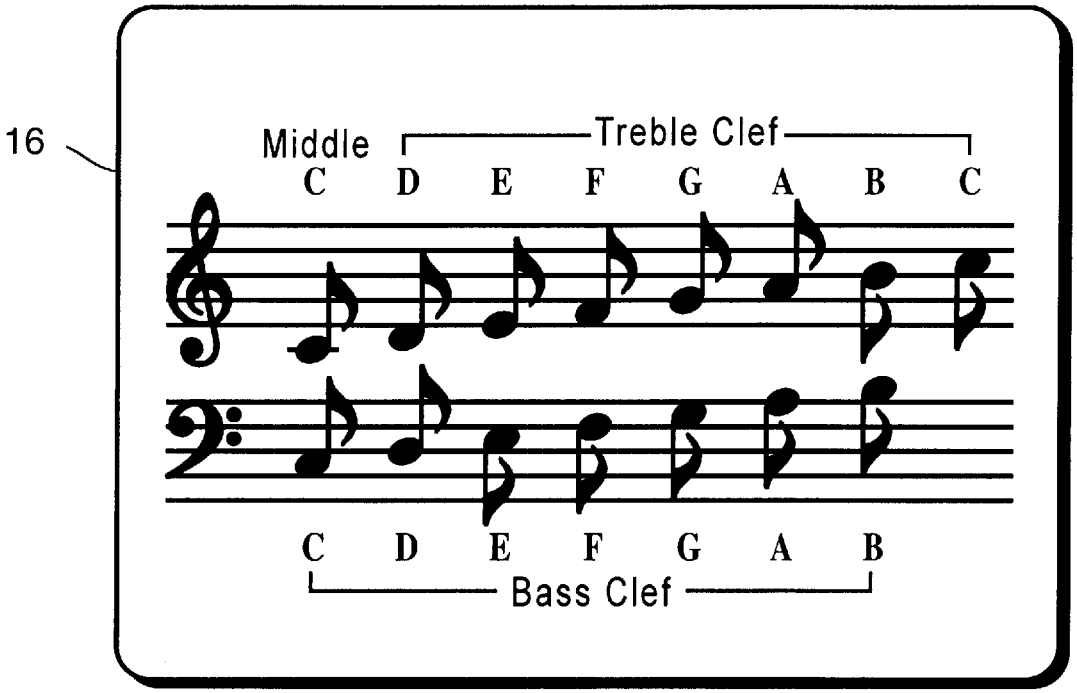
FIG. 3 shows a reference card, which indicates the names of all of the pitches.
Figure 4:
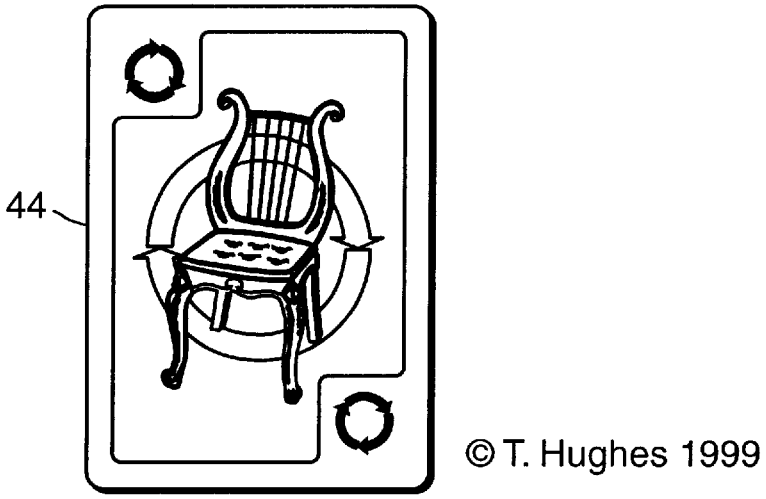
FIG. 4 shows a Musical Chair card.

A reference card 16 is included which is an instructional aid for initially learning and memorizing the names of the pitches. It is used as a reference only, and is not integral to any of the games. It is shown enlarged in FIG. 3 to properly show the detail. It is actually the same size as the other cards. A Musical Chair card 44 is used as a special purpose card as described in the version of the popular game "Crazy 8's", which is detailed later in this description.

In summary, this deck contains 65 musical notation cards made up of the following:

1 suit, or set of 21 cards with a blue background and a cartoon of a cat 1 suit, or set of 21 cards with a green background and a cartoon of an elephant 1 suit, or set of 21 cards with a red background and a cartoon of a bear 1 Musical Chair card 44

1 Reference card 16

Although the present invention has been described in its preferred embodiment, it should be understood by those skilled in the art that various changes and modifications may be made without departing from the spirit of the invention. While the illustrated embodiment has 3 suits, each with 21 musical symbols, it should be understood that other variations, such as the number of suits and the number of cards within each suit can be changed to accommodate other games and instructional techniques. A particular version with 4 suits is envisioned which can be used to play many games typically played on a standard poker deck.

Any number of musical notes can be represented on a given card. If notes were used alone, they would be distinguished from other note cards by their value (or duration) only.

Each pitch card in the typical embodiment shows one pitch, but other embodiments are envisioned which contain more than one pitch to indicate groupings of pitches, or chords. Any number of musical pitches can be represented, including all pitches playable on a typical 88-key piano. While eighth notes are used as the musical indicia in the preferred embodiment, any note value can be used, including whole notes down to sixty-fourth notes.

The rest sign indication in the preferred embodiment represents a quarter rest. Other rest sign indications can be used individually or as groups, which would include whole rests (4 counts) down to sixty-fourth rests.

A superset of the described embodiment utilizes 5 different rest signs and 3 octaves of pitch symbols, which allows more complex games to be played with more advanced students. The five rest symbols corresponding to the durations between and including a whole rest, half rest, quarter rest, eighth rest, and a sixteenth rest. The 3 octaves of pitch symbols are comprised of the 22 pitches of a 3-octave C-major scale between.and including the notes Lower Bass Clef G (corresponding to key 23 on a standard 88-key piano) and Upper Treble Clef G (corresponding to key 59 on a standard 88-key standard piano).

The sharp and flat signs, when used at the beginning of a phrase of music to indicate the key signature, can be shown in groups of between one and seven. Typically, all sharp signs are used together, and all flat signs are used together. When used to indicate a key signature, sharp signs and flat signs are not intermixed.

Furthermore, any musical symbols can be used, as long as game rules can be applied that describe the use of those symbols. Any colors, animals, instruments, or any suitable identifier can be used to denote suits. Each of the cards may be constructed of any material, such as cardboard, plastic, metal, or the like, and have a generally rectangular shape.

Usage of the inventive deck of cards involves the usual shuffling, dealing, and playing in turn, normally with the player on the left taking the next turn. The dealer can be determined by having all players select a card at random, and the person who selects the highest pitch card becomes the dealer. The status of dealer should shift to the person to the left of the previous dealer for each new hand within a game, and for the start of any new game. For young players, the eldest person may be the designated dealer. The first player of each hand is typically the person to the left of the dealer. Obviously, if the dealer remains constant throughout the game session, the person designated the first player should rotate through the group of players.

A version of the inventive deck can be made to exactly emulate a standard poker deck of cards by using 4 suits of 13 cards each. By mapping the musical pitches to their corresponding poker card values, relative value for the cards can be established. The following mapping can be used:

| Inventive Deck | Standard Poker Deck |
|---|---|
| Bass Clef C | Ace |
| Bass Clef D | Deuce |
| Bass Clef E | Three |
| Bass Clef F | Four |
| Bass Clef G | Five |

-continued

| Inventive Deck | Standard Poker Deck |
|---|---|
| Bass Clef A | Six |
| Bass Clef B | Seven |
| Middle C | Eight |
| Treble Clef D | Nine |
| Treble Clef E | Ten |
| Treble Clef F | Jack |
| Treble Clef G | Queen |
| Treble Clef A | King |

In this configuration, all games that use a standard poker deck can be played with the inventive deck. This association is primarily to indicate the relative value and sequence of the musical pitches in order to play standard games. For example, 3 sequential pitches of the C-major scale correspond to 3 sequential cards in the standard poker deck. Furthermore, the value of a sequence that ends in a higher pitch than another sequence would be of greater value. This association becomes clear in games such as Gin Rummy.

The mapping described above is merely meant to clarify the ways in which various popular games can be played with the inventive deck. The association is not a critical part of the memorization of the musical notation. This mapping purposely spans the treble and bass clef, so it is convenient for piano students to learn the most common notes. A similar mapping confined to the treble clef could be used for soprano voice students, or upper range instrumentalists, such as clarinetists. Likewise, a strictly bass clef mapping could be used for bass voice students, or lower range instrumentalists, such as trombonists.

Interesting embellishments to standard games arise by allowing matching cards to include octave matches in addition to exact (or unison) matches. For example, a Treble Clef A and a Bass Clef A could be considered a pair. Also, sequential series of cards could be defined to mean specific intervals between pitches, not simply in the order shown. Furthermore, matches could constitute pitches that fit within specific chords. These embellishments introduce unique musical characteristics into the games which allow players to enrich or modify their strategies.

The inventive deck of 65 cards and 3 suits described in detail in this disclosure supports at least ten different and unique games. In the preferred embodiment, a booklet accompanies the deck of cards describing in detail how the games can be played with this novel deck of cards. The games described cover a wide range of skill and age level. Some of the games can be played individually as solitaire games, while others can be played with up to 9 players. The rules for several of these games are listed below, much as they appear in the booklet. The games are given musical names to indicate that they are played with the inventive musical notation deck of cards.

MERRY WIDOW™

This game is a musical variation of the familiar game "Old Maid". It is designed for beginning students, and can be played by 2 to 4 players. Prior to the start of the game, select out of the deck of 65 cards, 8 pairs of matching cards (for example, 2 Treble Clef C's, 2 Bass Clef F's, 2 Rest Cards, and so on) of any suits that are desired, for a total of 16 cards. As the players' skill levels increase, or as the number of players increases, increase the number of pairs of cards used, up to 21 pairs. Multiple decks could be used to obtain even more pairs if desired.

The dealer passes out all but one card (a single card selected at any time during the deal) and places this card face down to the side of the playing surface. The player to the left of the dealer picks one card from any other player's hand and tries to create a pair of matching unison notes or symbols. Anytime a pair is formed, the player lays the pair of cards down face up on the playing surface, and names the note or symbol on the pair of cards. The turn then passes to the next player. Play continues until one person is left with an unmatched card. That player is the "Merry Widow" and will either win or lose, depending on how the players had decided to play the game.

HAYDN-SEEK™

This game is a musical variation of the familiar game "Memory". It is designed for intermediate students, and can be played by one or more players, one player at a time. Prior to the start of the game, select out of the deck of 65 cards, 12 pairs of matching cards (for example, 2 Treble Clef C's, 2 Bass Clef F's, 2 Rest Cards, and so on) of any suits that are desired, for a total of 24 cards.

Place these cards face down in a square or rectangle. The first player turns over 2 cards, naming each card. If they create a matching pair, he removes them and continues with another turn. If not, the second player takes his turn. The winner has the most matched pairs when the playing surface is cleared. This particular game is very useful for staging in new notes or symbols that need to be learned by the players.

OH SAY, CAN YOU "C"™

This game is a musical variation of the familiar game "7-Up". It is designed for intermediate students, and can be played by 2 to 9 players. Prior to the start of the game, select out of the deck of 65 cards, the 45 cards containing pitch symbols from all of the suits. Young children might find it easier to play with fewer cards, such as the 27 cards from Bass Clef F up to Treble Clef G in each suit. The dealer passes out all of the cards to the players. Some players may receive one more card than the other players, but that is irrelevant in this game.

On the dealer's indication, the players quickly pick up their cards and search for a Middle C card. The person who first places a Middle C card on the playing surface has started the game. The player to the left of that person can continue by playing either another Middle C card or by adding to the suit already played, moving up or down the C-major scale stepwise. The playing surface will eventually contain 3 Middle C cards laid down horizontally. The other sequential pitch cards being built up and down within the suit on their respective Middle C cards are laid down vertically, one side going up the scale, the other side going down. There will be 3 different piles, one for each suit. If at any time a player does not have a card to play, he must pass and look for another opportunity to play a card during his next turn. Players continue playing cards and naming them one pitch at a time to form the scales. The winner is the player who plays all of his card s first.

PRIMA DONNA™

This game is a musical variation of the familiar game "Klondike" solitaire. It is designed for advanced students, and is played by one player. Prior to the start of the game, select out of the deck of 65 cards, the 45 cards containing pitches from all of the suits.

The object is to end with all cards in a 2-octave upward scale, in each suit. During the initial deal, the player lays out 6cards in a row (left to right) face down except for the first card, to create 6 piles. He then lays out 5 cards on the last 5 piles, the first card face up, then 4 cards on the last 4 piles, the first card face up, and so on. This is the set up used in Klondike, except forming 6 piles instead of 7.

Play begins by building columns of downward scales on the 6 face up cards; for example, Middle C on Treble Clef D, Bass Clef F on Bass Clef G, etc., of any suit. Entire face up columns may be moved. When cards are removed from a pile, the top card may be turned over to continue play. If a pile becomes empty, it may be filled with a Treble Clef C (the highest card) from another pile or from the player's hand. Above these 6 columns of partial scales, the three Bass Clef C's are placed as they become available. The cards are then built upward on these three Bass Clef C's in a scale within the suit up to the Treble C. The remaining cards in the player's hand may be turned over, 3 at a time, playing the top card if possible, then the next, etc. The discard pile can be picked up and re-used, 3 cards at a time, for as many times as necessary. If no more cards can be played, the game is over. The object of the game is to build up all 3 scales completely, from the Bass Clef C's up to the Treble Clef C's.

BEGINNER CRAZY 8THS™

This game is a musical variation of the familiar game "Crazy 8's". It is designed for intermediate students, and can be played by 2 to 6 players. It uses the 45 pitch cards of the deck. The object of the game is to be the first player to discard all cards from his hand. The dealer passes out 6 cards to each player and turns over the top card to start a discard pile, naming that pitch.

The player to the dealer's left plays a card by matching either suit or pitch, and must name the pitch on that card. The pitch name must match, but it can be in any octave. For example, Treble Clef F can match Bass Clef F. If unable to play, the player then picks cards from the pile until he can play. A limit may be placed on the maximum number of cards drawn in any given turn. A Middle C Card, which may be played at any time, is wild and allows the player to change the suit.

Each player must name the pitch on every card that he plays. If the player names the card incorrectly or forgets, and is caught by any other player, the player must draw 2 cards as a penalty. On the other hand, if a player names a pitch incorrectly and is not caught by the time the next card is played, that player can make all other players draw 2 cards each. The first player to discard all of his cards wins the game.

COUNT BASIE™

This new game is designed for intermediate students, and can be played by 2 to 6 players. It uses the 15 pitch cards from any one suit of the deck. The cards are shuffled and laid out face down on the playing surface to form a 3 by 5 rectangle. Players take turns trying to find the correct card to build the musical scale starting from the lowest pitch (Bass Clef C) and ending with the highest (Treble Clef C). Each player must correctly name every pitch after the card is turned over. If that card is the next pitch of the scale, the player removes it, places it in a pile in front of him and continues play. If it is not the next pitch of the scale, that player turns the card back over and the following player takes his turn. The players try to remember the location and pitch of the previously exposed cards, in order to have the best chance of sequentially selecting the correct pitches of the scale.

The game is over when all cards have been removed. If scoring is desired, the cards collected can determine the score with each card counting as 1 point and the starting pitch (Bass C) counting as 5 points.

Figure 5:
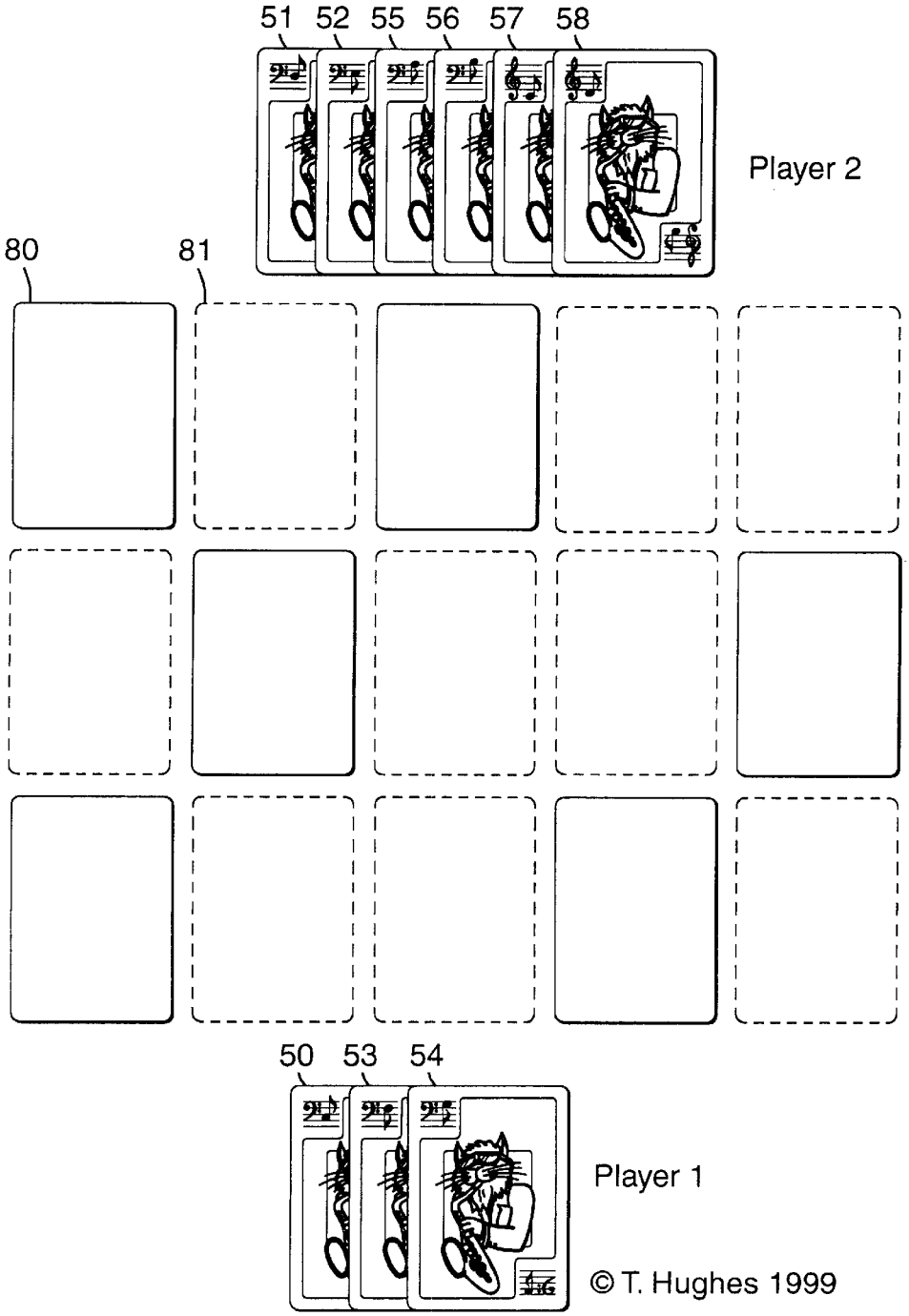
FIG. 5 shows the layout of the playing cards on the playing surface during a typical game of COUNT BASIE™.

FIG. 5 shows the layout of the playing cards on the playing surface about one-half way through a typical game. The 3 by 5 card array is shown, with the solid card outline 80 representing one of the face-down cards still in the array, and the dotted card outline 81 representing one of the spaces left after a card has been removed. The exposed cards 50, 53, and 54 are the cards that Player 1 has already withdrawn from the array, and exposed cards 51, 52, 55, 56, 57, and 58 are the cards that Player 2 has already withdrawn from the array.

Player 1 was the first to play since his cards start with the Bass Clef C card 50. During some subsequent turn or turns, Player 2 successfully selected the next two cards of the scale, Bass Clef D 51 and Bass Clef E 52. Player 1 then later successfully selected the next two cards of the scale, Bass Clef F 53 and Bass Clef G 54. Player 2 then subsequently selected the next four cards: Bass Clef A 55, Bass Clef B 56, Middle C 57, and Treble Clef D 58.

NAME THAT WORD™

This new game is designed for advanced students, and can be played by 3 to 5 players. It uses all 45 pitch cards from the deck. The dealer passes out seven cards to each player. The remaining cards are placed face down as a stock pile. Players attempt to spell words using as many cards as possible from their hands. When the first player has formed his word or words, he lays the cards face up in front of him. The first other player to correctly decipher the words is awarded 5 points. The first player then determines the score for his cards and writes it down. These cards are then placed into a discard pile, which can be reshuffled and placed back into the stock pile as needed. The player then draws cards from the stock pile to replenish his hand to seven cards. The next player then takes his turn. Players unable to form words may discard one card and draw one card from the stock pile. Play continues until a player has reached a predetermined target score, or a set time has been spent.

Scoring for each hand is awarded as follows:

(a) 1 or 2 letter word =5 points (for example, "A" or "BE")

(b) 3 letter word =10 points (for example, "ACE")

(c) 4 letter word =15 points (for example, "FACE")

(d) 5 letter word =20 points (for example, "BADGE")

(e) 6 letter word =50 points (for example, "BEGGED")

(f) 7 letter word =75 points (for example, "CABBAGE")

(g) Words formed in the same suit results in the score being doubled.

(h) Words formed in the same suit and the same clef results in the score being tripled.

(i) If all 7 cards are used in one hand, a 25 point bonus is added.

Figure 6:
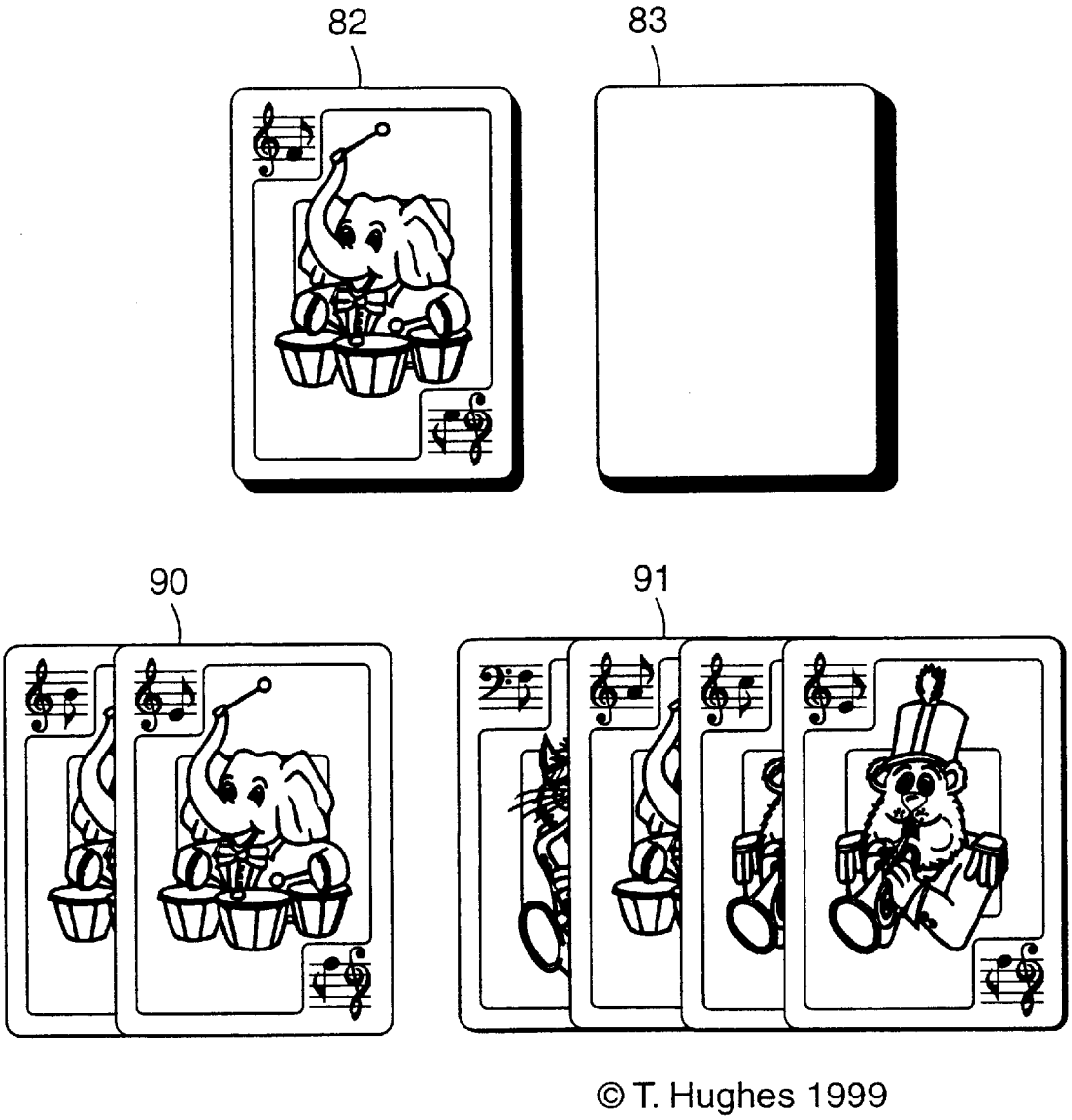
FIG. 6 shows the layout of the playing cards on the playing surface during a typical game of NAME THAT WORD™.

FIG. 6 shows the layout of the playing cards on the playing surface during a typical game. A player has just laid down the cards in two groups, showing two words. The cards of the first group 90 are Treble Clef B and Treble Clef E, spelling the word "BE", with cards from the same suit and the same clefs. The score for this group would be 15 points. The cards of the second group 91 spell the word "FACE", with cards from different suits and clefs. The score for this group would be 15 points. The total score for this hand would be 30 points. The discard pile 82 and the stock pile 83 are shown.

After the basic pitch recognition has been mastered, the additional musical notation cards can be used to add entertaining musical elements. The following example illustrates this point.

CRAZY 8THS™

To add interest to the aforementioned BEGINNER CRAZY 8THS™ game, the other musical notation cards can be added. This game uses all 64 playing cards of the deck, so only the Reference Card is removed.

The Repeat Card 67, played by matching the suit of the last card played, permits another card of that suit to be played by the same person. A second or third Repeat Card may also be played, followed by another card of that suit. A Repeat Card must be followed by another card of that suit even if it is the last card played. If the player does not have one in his hand, he must draw from the deck until he can play.

A Rest Card 65, played by matching the suit or symbol of the last card played, forces the next player to be skipped. The player skipped must be totally quiet until the following player plays a card, or the player who is skipped must draw 2 cards. This is musically significant since a rest symbol indicates silence.

A Triplet Card 66, played by matching the suit or symbol of the last card played, indicates that the next player must play another Triplet Card. If he is unable to do so, he must draw 3 cards, but then is allowed to play any card matching the suit last played, or he may pass.

A Sharp Card 70, played by matching the suit or symbol of the last card played, indicates that the player to the right must draw one card. The direction "right" is musically significant because the sharp symbol corresponds to raising a pitch one half step, which would be to the right on a piano.

A Flat Card 71, played by matching the suit or symbol of the last card played, indicates that the player to the left must draw one card. The direction "left" is musically significant because the flat sign corresponds to lowering a pitch one half step, which would be to the left on a piano.

A Natural Card 72, played by matching the suit or symbol of the last card played, indicates that all other players must draw one card.

The Musical Chair Card 44 may be played at any time during the game, and it indicates that everyone must lay their cards down on the playing surface and physically move to the next seat to the left. For those not desiring to physically move, the same result is obtained by passing the entire hand of cards to the player to the right. The person who played the Musical Chair Card then continues with another turn using his new hand of cards by playing any card he wishes.

Figure 7:
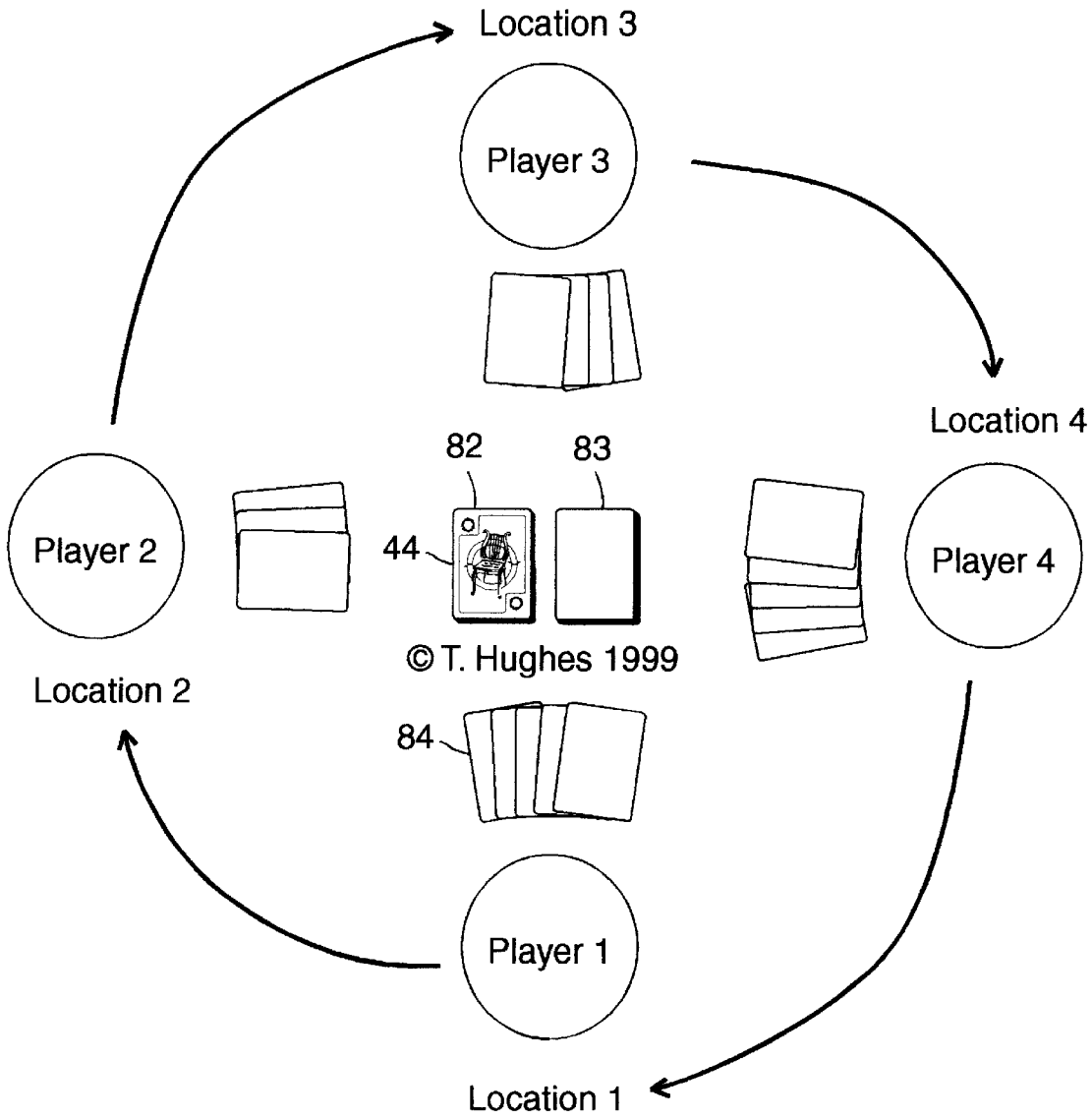
FIG. 7 shows the movement of players after the Musical Chair card has been played during a game of CRAZY 8THS™.

FIG. 7 shows the motion of the players as a result of the Musical Chair Card 44 just being played on the discard pile 82. Player 1 lays his cards 84 face down on the playing surface and moves to the location 2, which was the location previously occupied by Player 2, and so on. The stock pile 83 is shown for completeness.

When one player has successfully discarded all cards from his hand, the other players lay down their remaining cards to be counted. The cards with pitches all count as 5 points each, the Musical Chair Card counts as 25 points, and all other cards count as 10 points each. The player who discarded all of his cards first receives the total score of all of the other players. The players may wish to play to a predetermined amount, such as 100.

As can be seen from the previous game descriptions, the inventive versatile deck of cards can support of variety of games. Some are new version of traditional games, while others are new games that take advantage of the new rules of musical notation.

Embellishments can be added with the extra musical notation symbols, as exemplified in the CRAZY 8THS™ description above. The cards are general enough in nature to allow players to eventually invent new games, or generate adaptations of other familiar card games. Increased fluency in the language of music can be achieved by playing increasingly difficult or more complex games.

Once the basic musical pitches are memorized and the students are comfortable with using the inventive deck, new games can be introduced that introduce other musical concepts, such as rhythm, chord structure and key signatures.

Accordingly, the present invention provides an entertaining and effective system for learning and memorizing musical notation. The invention is an important tool that can be used by parents and teachers to motivate students and stimulate their interest in reading music. The solitaire games are valuable for self-instruction and practice. Music is a complex language, and by familiarizing oneself with the written notation, one can understand and enjoy reading music.

The layout and structure of the games lend themselves well to being implemented in a video format.

While the invention has been particularly shown and described with reference to the preferred embodiment thereof, it will be understood by those skilled in the art that various alterations may be made without departing from the spirit and scope of this invention and that all such as fall within the reasonable scope of the appended claims are included.

The embodiments of the invention in which an exclusive property or privilege is claimed are defined as follows:

1. An educational game comprising:

a deck of playing cards containing a plurality of suits, each suit being identified by a figural cartoon on a colored background, so labeled in the center of each card, said suit designation being exactly the same on each card within each said suit, each card within said suit carrying different and unique indicia thereon that represents a single symbol of musical notation only, each and every card within a suit having exactly one matching card with identical musical notation in each other suit.

2. The apparatus of claim 1, wherein the single symbol of musical notation on each card may be any one of the following symbols: note symbol, rest symbol, sharp symbol, flat symbol, natural symbol, repeat symbol, or triplet symbol.

3. The apparatus of claim 2, wherein the note symbols are comprised of single eighth notes, with each note card representing each of the consecutive pitches of a two to four octave scale.

4. The apparatus of claim 3, wherein the consecutive pitches of a two to four octave scale span both the Bass Clef and the Treble Clef within each suit.

5. The apparatus of claim 1, wherein the deck of playing cards includes a musical chair card containing only a designation of a chair, said card being unique in the deck and not belonging to any suit.

6. The apparatus of claim 1, wherein the deck of playing cards includes a reference card, not for use in regular play and not part of a suit, which identifies the letter names of all of the pitches used in that particular deck of playing cards.

7. A deck of playing cards containing a plurality of suits, each suit being identified by a figural cartoon on a colored background, so labeled in the center of each card, said suit designation being exactly the same on each card within each said suit, each card within said suit carrying different and unique indicia thereon that represents a single symbol of musical notation only, each and every card within a suit having exactly one matching card with identical musical notation in each other suit, said deck including a special purpose playing card containing a depiction of a chair, said card being unique in the deck and not belonging to any suit.

8. The apparatus of claim 7, wherein the chair designation is a symbol designed to represent the game "Musical Chairs".

* * * * *